US005427589A

United States Patent [19]

Holsten et al.

[11] Patent Number: 5,427,589

[45] Date of Patent: Jun. 27, 1995

[54] METHOD FOR DYEING FIBROUS MATERIALS

[75] Inventors: John R. Holsten, Rock Hill; Moses Smith, Jr., Lancaster, both of S.C.

[73] Assignee: Springs Industries, Inc., Fort Mill, S.C.

[21] Appl. No.: 25,988

[22] Filed: Mar. 3, 1993

[51] Int. Cl.[6] ..... D06P 1/62; D06P 1/64; D06P 3/24; D06P 3/26

[52] U.S. Cl. ..... 8/586; 8/589; 8/925; 8/611; 8/934; 8/657; 8/650; 8/673; 8/680; 8/908

[58] Field of Search ..... 8/589, 586, 902–908, 8/912, 925, 934, 611, 650, 657, 673, 680, 586, 9

[56] References Cited

U.S. PATENT DOCUMENTS

| | | | |
|---|---|---|---|
| 2,895,948 | 7/1959 | Brinker et al. | 260/78.4 |
| 2,997,447 | 8/1961 | Russell | 252/351 |
| 3,232,695 | 2/1966 | Robin et al. | 8/53 |
| 3,363,969 | 2/1968 | Brooks | 8/17 |
| 3,558,267 | 8/1967 | Langenfeld | 8/586 |
| 3,616,473 | 11/1971 | Leach | 8/586 |
| 3,634,023 | 1/1972 | Foote | 8/130.1 |
| 3,706,524 | 12/1972 | Flensberg | 8/21 A |
| 3,741,719 | 6/1973 | Ramanathan | 8/654 |
| 3,789,091 | 1/1975 | Anderson et al. | 260/927 |
| 3,918,901 | 11/1975 | Ida et al. | 8/535 |
| 3,929,408 | 12/1975 | Ravet et al. | 8/169 |
| 3,953,168 | 4/1976 | Fabbri | 8/477 |
| 4,063,880 | 12/1977 | Tullio | 8/41 R |
| 4,066,396 | 1/1978 | Wolf et al. | 8/178 A |
| 4,073,615 | 2/1978 | Lacroix et al. | 8/527 |
| 4,108,936 | 8/1978 | Wolf | 264/78 |
| 4,144,024 | 3/1979 | Lala | 8/25 |
| 4,221,566 | 9/1980 | Lazar et al. | 8/582 |
| 4,397,759 | 8/1983 | Hancock | 252/609 |
| 4,444,563 | 4/1984 | Abel | 8/588 |
| 4,563,190 | 1/1986 | Töpfl | 8/524 |
| 4,563,192 | 1/1986 | Salathé | 8/554 |
| 4,572,300 | 6/1988 | Johnson | 8/584 |
| 4,705,523 | 11/1987 | Hussamy | 8/490 |
| 4,710,200 | 12/1987 | Cates et al. | 8/574 |
| 4,715,863 | 12/1987 | Navratil et al. | 8/440 |
| 4,758,649 | 7/1988 | Asano | 528/73 |
| 4,780,105 | 10/1988 | White | 8/574 |
| 4,861,342 | 8/1989 | Danel | 8/444 |
| 4,883,495 | 11/1989 | Jaeckel et al. | 8/115.6 |
| 4,891,398 | 1/1990 | Tanaka et al. | 524/181 |
| 4,898,596 | 2/1990 | Riggins | 8/490 |
| 5,092,904 | 3/1992 | Neely | 8/574 |
| 5,174,790 | 12/1992 | Riggins et al. | 8/490 |
| 5,207,803 | 5/1993 | Holsten et al. | 8/586 |

FOREIGN PATENT DOCUMENTS

| | | |
|---|---|---|
| 2180131 | 11/1973 | France . |
| 1275459 | 5/1972 | United Kingdom . |
| 1282113 | 7/1972 | United Kingdom . |

OTHER PUBLICATIONS

Evaluation of the STX System for Solvent Dyeing of Industrial Fabrics Part II;, Fred L. Cook and Madeline L. Averette 1983.

Aramid Fibers, Kirk-Othmer: The Encyclopedia of Chemical Technology Third Edition, vol. 3, pp. 213–242 1978.

Chemical Abstracts, vol. 98, No. 14, 4 Apr. 1983, Abstract 108808.

*Primary Examiner*—Paul Lieberman
*Assistant Examiner*—Margaret Einsmann
*Attorney, Agent, or Firm*—Bell, Seltzer, Park & Gibson

[57] ABSTRACT

A method for dyeing fibrous material is provided. The method includes contacting a fibrous material with a dyebath comprising a mixture of a dye assistant and a dye soluble or dispersed with dye assistant in the dyebath. The dye assistant comprises a salt of a low molecular weight aromatic sulfonic acid, and can include a low molecular weight surfactant. The dye assistant of the present invention can be advantageously utilized for dyeing difficult to dye fibers such as aromatic polyamide fibers, polybenzimidazole fibers and aromatic polyimide fibers.

36 Claims, No Drawings

METHOD FOR DYEING FIBROUS MATERIALS

The present invention relates to a method for dyeing fibrous material, and particularly fibrous materials having flame resistant properties and which are difficult to dye such as aromatic polyamides, polybenzimidazoles or aromatic polyimides.

BACKGROUND OF THE INVENTION

There are various recognized methods for dyeing and/or incorporating additives into fibers and other fibrous materials, including methods which utilize organic solvents such as dimethylsulfoxide ("DMSO"), dimethylacetamide ("DMAc"), dimethylformamide ("DMF"), N-methylpyrrolidone ("NMP"), N-cyclohexyl-2-pyrrolidone ("CHP"), acetophenone, acetanilide and methyl benzoate. Exemplary systems utilizing these organic solvents have been proposed in U.S. Pat. Nos. 3,558,267 to Langenfeld, 3,741,719 to Ramanathan et al, 4,525,168 to Kelly, and U.S. Pat. No. 4,898,596 to Riggins et al and U.K. Patent Nos. 1,275,459 to Gruen and 1,282,113 to Burtonshaw et al.

The organic solvents are sometimes referred to as "swelling agents" in that solvents swell the fiber to permit the dye molecules to be introduced into the fiber. It is believed that when the solvent is removed (e.g., by heating), the fiber returns to its original condition and the dye molecules are entrapped in the fiber. Certain of the organic solvent swelling agents, however, tend to damage the fibers by the swelling action, or result in the undesirable side effect of retention of solvent by the fibers. Retention of solvent can adversely affect both the appearance and the flame resistance of the fibers.

Retention of solvent is particularly frustrating when dyeing fibers such as the aromatic polyamides, i.e., poly-m-phenylene isophthalamide) ("Nomex®") and poly(p-phenylene terephthalamide) ("Kevlar®"), polybenzimidazoles, aromatic polyimides, and the like which have excellent flame resistant properties but also are difficult to dye. In order to dye these fibers, some of the various organic solvents and carriers, e.g., DMAc, DMSO, DMF, acetophenone, etc., have to be used. Commercial use, however, may not be desired and may be perceived by some workers as noxious. Moreover, if non-water soluble, the solvents also tend to be retained by the fibers after dyeing. Thus, prior art techniques for dyeing these fibers can be counter-productive in that one of the problems caused by retention of solvent (e.g., decreased flame resistance) requires addition of a significantly large portion of a flame retardant to compensate for the reduction in the flame resistant properties of the fibers.

It is therefore an object of the present invention to provide an improved method for dyeing fibrous materials, and particularly to provide a method which obviates the need to utilize organic solvents and carriers.

It is another object of the present invention to provide a method having one or more particularly advantageous results, including increased efficiency in dye exhaustion and more uniform dyeing as compared to the absence of a carrier or organic solvent, and reduction of the retention of solvent as compared to organic solvents.

The improved method is particularly advantageous when used with difficult to dye fibers such as aromatic polyamide fibers (e.g., Nomex® and Kevlar® fibers), polybenzimidazole fibers, aromatic polyimide fibers, fibers of copolymers of the monomers thereof and blends thereof.

SUMMARY OF THE INVENTION

This invention relates to a method for dyeing fibrous material which includes the steps of contacting the fibrous material with a mixture (e.g., a solution or dispersion) containing a dye assistant and a dye (e.g., a dyebath). The dye assistant comprises a salt of a low molecular weight aromatic sulfonic acid such as an ammonia or alkali metal salt of p-toluenesulfonic acid, m-nitrobenzenesulfonic acid, xylenesulfonic acid, cumenesulfonic acid, naphthalenesulfonic acid and the like, and fixing the dye in the fibrous material. The use of the present dye assistant results in improved dyeing characteristics. For example, reduction in the retention of solvent is achieved as compared to comparable levels of swelling agents (e.g., organic solvents) particularly when used to dye fibers such as aromatic polyamide fibers, polybenzimidazole fibers, aromatic polyimide fibers, fibers of copolymers of the monomers thereof and blends thereof.

In accordance with a particularly preferred embodiment of the present invention, the method includes the steps of contacting aromatic polyamide fibers, polybenzimidazole fibers, aromatic polyimides fibers, fibers of copolymers of the monomers thereof, or blends thereof with an aqueous dyebath comprising a mixture of a dye assistant and dye soluble or dispersed with the dye assistant in the dyebath, the dye assistant comprising a salt of a low molecular weight aromatic sulfonic acid, and a low molecular weight surfactant.

In accordance with another particularly preferred embodiment of the present invention, the method of the present invention includes the steps of prescouring the fibrous material with a bath including a salt of a low molecular weight aromatic sulfonic acid and contacting the fibrous material with an aqueous dyebath comprising a mixture of a dye assistant and dye soluble or dispersed with the dye assistant in the dyebath, the dye assistant comprising a salt of a low molecular weight aromatic sulfonic acid and a low molecular weight surfactant.

DETAILED DESCRIPTION OF THE INVENTION

As summarized above, the present invention provides an improved dyeing system which obviates the need for using organic solvents, and more particularly reduces or substantially eliminates the need for using organic solvents to swell the fibers. The dye assistant and method is particularly adapted for use in reducing the adverse effect of dyeing methods on dye exhaustion, dye uniformity and flame resistant properties of the fibrous material, particularly those effects caused by the use of organic solvents to swell fibers. The dye assistant preferably comprises a low molecular weight salt of an aromatic sulfonic acid. In a preferred embodiment, the dye assistant can include a low molecular weight surfactant.

The method of the present invention can advantageously be employed using customary dyeing techniques. The dye and the dye assistant, and any other additives are typically utilized by forming a mixture (e.g., a bath, solution, dispersion or the like) of the dye and the dye assistant of the present invention followed by contacting the fiber and/or fabric with this mixture and then preferably fixing the dye in the fiber. In accordance with the present invention, a fibrous textile material, e.g., fiber, web, yarn, thread, sliver, woven fabric, knitted fabric, non-woven fabric, and the like is impregnated, padded, or otherwise contacted with the bath and the dyestuffs and/or additives fixed in the substrate using conventional equipment such as jet dyeing or other appropriate equipment.

The dye assistant of the present invention comprises a hydrotrope such as a salt of an aromatic sulfonic acid. The term "hydrotrope" relates to compounds which solubilize organic compounds (e.g., dyes) in water or the aqueous phase to permit more of the compounds to be dissolved. In contradistinction to organic solvents which tend to swell fibers to permit dyeing, the Applicants believe, although they are not intending to be bound by any theory, that the hydrotropes of the present invention enhance dyebath solubility of the dyes. The hydrotropes also tend to break-up the multimolecular complexes (i.e., micelles) of the dye into smaller and more than likely single dye molecules which are capable of rapidly moving to the fiber surface and are readily adsorbed by the fibers being dyed. Particularly suitable hydrotropes are salts of an aromatic sulfonic acid. Exemplary salts of the aromatic sulfonic acid are ammonium or alkali metal of relatively small (i.e., having a low molecular weight, namely having from 6 to 12 carbon atoms) aromatic sulfonic acids. Suitable salts are, for example, ammonium, sodium or potassium salts of p-toluenesulfonic acid, m-nitrobenzenesulfonic acid, xylenesulfonic acid, cumenesulfonic acid, and $\alpha$ and $\beta$-napthalenesulfonic acid. A particularly preferred salt is the sodium salt of xylenesulfonic acid (sodium xylenesulfonate) available under the trademark "Naxonate" from Rüetgers-Nease Chemical Co., Inc. of State College, Pa.

The dye assistant can include a low molecular weight surfactant. The low molecular weight surfactant contributes to wetting-out the fiber by rapidly moving from the aqueous dyebath to the surface of the fiber and deaerating the same to improve dye exhaustion. Preferably the low molecular weight surfactant is nonethoxylated and can be anionic or nonionic or mixtures thereof. If a nonionic surfactant is used, it is preferred to add an electrolyte such as sodium nitrate or sodium sulfate. It is believed that the electrolyte tends to drive the dye out of solution onto the surface of the fiber for adsorption thereon. A suitable nonionic low molecular weight surfactant includes 2,4,7,9-tetramethyl-5-decyne-4,7 diol available under the trademark "Surfynol 104" or "Surfynol 104A" (50 percent by weight solution in 2-ethylhexanol).

A suitable anionic surfactant is a 75 percent active solution of sodium dioctylsulfosuccinate in ethanol and water available under the trademark "Geropon SS-O-75" from Rhône-Poulenc, Cranbury, N.J. It is noted that a defoamer can be added when using anionic surfactants to improve processing. An exemplary defoamer is "Quadefome NS" available from Rhône-Poulenc. If an anionic surfactant is used, the eletrolyte is not necessary.

The weight ratio of salt of an aromatic sulfonic acid to low molecular weight surfactant to electrolyte may suitably be from about 0.5:0:0 to 5.0:0.5:5.0, preferably about 2.5:0.25:4.0, when using the nonionic surfactant, and about 2.5:0.13:0.4 when using the anionic surfactant. The total weight of the dye assistant in the dyebath may suitably be in the range from about 3 to 7 percent based on the weight of the dyebath. The weight percent can be adjusted using water or any other liquid miscible or dispersible with the dye assistant.

In view of the desirable results achieved to date, it is thought that the use of the dye assistant of the present invention is applicable with a wide variety of additives such as flame retardants, softeners, UV absorbers, IR absorbers, antistatic agents, antifoaming agents, bactericides, fungicides, anti-viral agents or the like, and to a wide variety of fibrous material and includes dyed fibers which have been formed into fabrics including woven, non-woven or knit fabrics, for example.

The dye assistant also may include a minor proportion (i.e., less than 50 percent by weight) of an agent to facilitate providing the dye in solution and carrying the dye into the fiber. Exemplary agents include N-substituted aromatic carbonamides and N,N-disubstituted aromatic carbonamides. A particularly preferred N,N-disubstituted aromatic carbonamide is N,N-diethyl(m-toluamide) ("DEET"). Other agents include organic solvents such as dimethylsulfoxide ("DMSO"), N-methylpyrrolidone ("NMP"), N-cyclohexyl-2-pyrrolidone ("CHP"), acetophenone, acetanilide, and methyl benzoate.

The dye assistant can be used advantageously to dye a variety of flame resistant fibers which are difficult to dye, namely, aromatic polyamides, polybenzimididazoles, and aromatic polyimides, copolymers of the monomers thereof, and blends thereof. As noted above the carrier is particularly desirable for use with aromatic polyamides. Fibers of aromatic polyamides have flame resistant properties and are often generically termed "aramid fibers" and are described, for example, in *Kirk-Othmer: The Encyclopedia of Chemical Technology*, Third Edition, Vol. 3, pp. 213–242. The term "aromatic polyamides" or "aramids" includes but is not limited to poly(m-phenyleneisophthalamide) (e.g., Nomex ®), poly(p-phenyleneterephthalamide) (e.g., Kevlar ®), polyparabenzamide, copolymers of the monomers thereof, and blends therewith. Nomex ® is available from DuPont of Wilmington, Del., in three forms. Nomex ® T-450 is a 100 percent, undyed poly(m-phenyleneisophthalamide); Nomex ® T-456 is 100 percent solution dyed poly(m-phenyleneisophthalamide); and Nomex ® T-455 is a blend of 94 percent Nomex ® (poly(m-phenyleneisophthalamide)) and 6 percent Kevlar ® (poly(p-phenyleneterephthalamide)). It is noted that DuPont has recently changed its formulation of Nomex ® T-455 to this formulation. The old formulation had 95 percent Nomex ® and 5 percent Kevlar ®. Nomex ® T-455 is the most common type of Nomex ® used commercially.

Another group of fibers which have flame resistant properties and are difficult to dye are the polybenzimidazole fibers available from Höechst-Celanese of Charlotte, N.C. and are described in U.S. Pat. No. 2,895,948 to Brinker et al, the disclosure of which is incorporated herein by reference. Polybenzimidazoles use specific dicarboxylic and tetramine compounds as monomers and have the repeating unit of the formula:

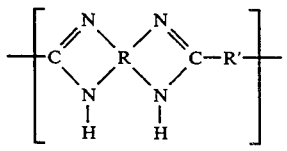

where R and R' are aromatic moieties.

Another group of fibers having flame resistant properties and are difficult to dye are aromatic polyimide fibers described in U.S. Pat. No. 4,758,649 to Asano et al, the disclosure of which is incorporated herein by reference. The aromatic polyimides have the repeating unit of the formula:

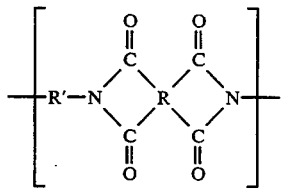

where R and R' are aromatic moieties.

In addition, copolymers of monomers or blends of the aromatic polyamides, polybenzimidazoles and/or aromatic polyimides can advantageously be dyed using the present carrier. For example, aromatic polyamide fibers and polybenzimidazole fibers can be blended in a weight ratio of about 60:40 to about 80:20 aromatic polyamide fibers to polybenzimidazole fibers. The blends can be in the form of intimate blends, draw blends, corespun and the like. Additionally other synthetic fibers such as acrylic, modacrylic, polyesters and aliphatic polyamides can be advantageously dyed using the dye assistant of the present invention.

Dyes which can be used advantageously with the present carrier can include acid dyes (e.g., azo, triarylmethane, anthraquinone dyes etc.); basic dyes (e.g., triphenylmethane, thiazide dyes, etc.); disperse dyes; and vat dyes; and mixtures thereof with the proviso that the dyes do not decompose under customary dyeing conditions. Particularly effective dyes for dyeing aromatic polyamide fibers, polybenzimidazole fibers and aromatic polyimide fibers are the basic dyes (sometimes referred to as "cationic dyes"). Examples of this class are the Basacryl® dyes available from BASF, Charlotte, N.C. and the Maxillon® dyes available from Ciba-Geigy Corporation, Greensboro, N.C.

In operation, the dye and/or other additive is preferably applied to the fibers of a fabric using a one-step batch-type process at 100° F. to 300° F. at 1 to 4 atm pressure. Pre-scouring and after-scouring of the fabric is preferred. For example, the fabric can be prescoured by passing the fabric through a hot aqueous scour which includes a salt of an aromatic sulfonic acid (i.e., the dye assistant) in a jet dye machine or other scouring equipment. The jet is then charged with water and other auxiliaries including the dye and the dye assistant with or without the low molecular weight surfactant, and with or without an electrolyte or other additive. The pH of the dyebath is maintained at from about 2 to 4, and preferably from about 2 to 3 when an anionic low molecular weight surfactant is used and from about 2.5 to 4.0 when a nonionic low molecular weight surfactant is used. The temperature and pressure are then increased to a temperature above about 250° F. and preferably above about 270° F. and a pressure above about 2.5 atm and held for about 30 minutes to about 1.5 hours while the jet is working. The fabric is allowed to cool, the dyebath dropped, the fabric rinsed and then an after-scour is performed using a wetting agent and soda ash in the jet. The resulting fabric has greater than about 50 percent of the charged dyestuff, preferably about 80 percent exhausted into the fabric. The dye and any additives are fixed into the fiber during the dye cycle.

Additional benefits and advantages of the invention will be apparent from the following illustrative examples.

EXAMPLE 1

A 7.5 oz/yd$^2$ fabric formed from Nomex® T-455 (94% Nomex® and 6% Kevlar®) fibers is prescoured 30 minutes at 160° F. in a bath comprising 2% owf ("on weight of fabric") soda ash, and 2% owf Apex 1600 scouring agent available from Apex Chemical Corporation of Elizabeth, N.J. All dyeings are run at a 10:1 liquor-to-goods ratio unless otherwise stated using prescoured Nomex®. Percent owb figures given are based upon full bath weight.

A 10.0 g swatch of the prescoured Nomex® fabric is slurried in an Ahiba cup for 5 minutes with approximately 30–35 ml of warm (approximately 120° F.) aqueous solution containing 3.80% owb of dissolved sodium xylenesulfonate. A stock navy cationic dye solution is added to provide 11.25% owf 100% Basacryl Blue X-3GL, 1.41% owf Basacryl Red GL, 0.90% owf Basacryl Golden Yellow X-GFL and 0.125% owf Vanquest DT (18% by weight solution of ethylenediamine tetraacetic acid, sodium salt with 0.3 to 0.5% trisodium nitrilotriacetate) available from Vantex, Inc., Oakboro, N.C. Acetic acid (56% by weight) is added at 2.0% owf. This mix is slurried for 5 minutes at 120° F. and then brought to full volume (100 ml.) to provide a 10:1 liquor-to-goods ratio by the addition of an aqueous solution containing 0.49% owb dissolved sodium nitrate. The cup is closed and the cup placed in the Ahiba oil bath where the oil temperature is raised to 270° F. at a rate of 3° F./minute. The fabric is dyed for an extended period of 60 minutes at an elevated temperature of about 270° F. and at a pressure of about 2.85 atm. The dyed fabric is cooled to 140° F., the dyebath dropped and the fabric rinsed clean in cold water.

An after-scour is done at a 10:1 liquor-to-goods ratio in a bath comprising about 2% owf of soda ash and about 2% owf Apex 1600 scouring agent. The temperature is raised to 160° F. and the fibers of the fabric scoured for 30 minutes at 160° F. The scouring bath is dropped and the fabric rinsed until the rinse is clear. The fabric is then dried.

The depth of shades of the fabrics are determined subjectively by sight, and objectively using the C.I.E. L*, a*, b* scale. The C.I.E. L*, a*, b* scale uses a colorimeter available from HunterLab of Fairfax, Va. set at 10° illumination and having a D65 light source. The C.I.E. L*, a*, b* scale is based on the opponent-colors theory of color vision which presumes that in the human eye there is an intermediate signal-switching stage between the light receptors in the retina and the optic nerve taking color signals to the brain. In this switching stage, red responses are compared with green to generate a red-to-green color dimension. The green (or red and green together, depending on theory used) response is compared in a similar manner with the blue to generate a yellow-to-blue color dimension. These two dimensions are often, though not always, associated with the symbols "a*" and "b*", respectively. The necessary third dimension, "L*", for lightness, is usually a non-linear function such as the square root or cube root of one of the dimensions and is typically reported as a "C.I.E. L*" value. The resulting fabric of Example 1 had a deep shade of blue and a C.I.E. L* value of 21.18.

A fabric dyed using the same process as Example 1 but no hydrotrope-type dye assistant had a C.I.E. L* value of 32.77. The obtained C.I.E. L* value compares satisfactorily to those obtained with certain organic solvent swelling agents and carriers.

EXAMPLE 2

In order to demonstrate the effectiveness of varying concentrations of sodium xylenesulfonate, the steps of Example 1 are repeated except 2.4% owb sodium xylenesulfonate is used as the dye assistant. The resulting fabric has a deep shade of blue, and a C.I.E. L* value of 21.23.

EXAMPLE 3

In order to demonstrate the effectiveness of varying concentrations of sodium xylenesulfonate, the steps of Example 1 are repeated except 1.2% owb sodium xylenesulfonate is used as the dye assistant. The resulting fabric has a deep shade of blue, and a C.I.E. L* value of 23.24.

EXAMPLE 4

In order to demonstrate the effectiveness of varying concentrations of sodium xylenesulfonate, the steps of Example 1 are repeated except 0.6% owb sodium xylenesulfonate is used as the dye assistant. The resulting fabric has a deep shade of blue, and a C.I.E. L* value of 26.45.

The results of Examples 2–4 indicate that varying concentrations of sodium xylenesulfonate dye assistant can be used to dye Nomex®.

EXAMPLE 5

In order to demonstrate the effectiveness of the addition of a nonionic low molecular weight surfactant to the dye assistant, the steps of Example 1 are repeated except 0.1% owb Surfynol 104 (2,4,7,9-tetramethyl-5-decyne-4,7 diol) low molecular weight surfactant is added with 3.72% owb sodium xylenesulfonate. The resulting fabric had a deep shade of blue and a C.I.E.L* value of 19.30.

EXAMPLE 6

In order to demonstrate the effectiveness of a different amount of the low molecular weight surfactant, the steps of Example 1 are repeated except 0.25% owb Surfynol 104 is added to 3.72% owb sodium xylenesulfonate. The resulting fabric had a deep shade of blue and a C.I.E. L* value of 18.70.

EXAMPLE 7

In order to demonstrate the effectiveness of a different, nonionic low molecular weight surfactant, the steps of Example 1 are repeated except the acetic acid is omitted. The dyebath pH is adjusted to 3.5–3.6 with sodium acetate and 0.20% owb Surfynol 104A (50 percent by weight solution of 2,4,7,9-tetramethyl-5-decyne-4,7 diol in 2-ethylhexanol) nonionic low molecular weight surfactant is added with 2.50% owb sodium xylenesulfonate. The resulting fabric had a deep shade of blue and a C.I.E. L* value of 17.30.

EXAMPLE 8

In order to demonstrate the effectiveness of a different and anionic low molecular weight surfactant, the steps of Example 1 are repeated except the acetic acid is omitted. The dyebath pH is adjusted to 3.5–3.6 with sodium acetate and 0.133% owb Geropon SS-0-75 (75% active solution of sodium dioctylsulfosuccinate in ethanol and water) anionic low molecular weight surfactant is added to the dye assistant. 0.03% owb Quadefome NS defoamer is also added. The resulting fabric had a deep shade of blue and a C.I.E. L* value of 17.59.

The results of Examples 5–8 indicate that different nonionic or anionic low molecular weight surfactants, and varying concentrations thereof can be used.

EXAMPLE 9

In order to demonstrate the effectiveness of prescouring and the addition of additional electrolyte, 84.2 lbs of fabric formed from Nomex® T- 455 is prescoured at 160° F. for 30 minutes in a bath comprising 2.0% owf soda ash, 2.0% owf Apex 1600 scouring agent and 5.0 owf Naxonate SX (4.65% owf sodium xylenesulfonate).

The jet dye apparatus containing the presoured Nomex® fabric is loaded with 30–35% of the water volume needed to provide a 10:1 total volume liquor-to-goods ratio. This water contains 2.50% owb dissolved sodium xylenesulfonate and is set at 120° F. The fabric is run in this solution for five minutes. A navy blue cationic dye stock solution containing 11.25% owf 100% Basacryl Blue X-3GL, 1.41% owf Basacryl Red GL and 0.90% owf Basacryl Golden Yellow X-GFL along with 0.013% owb Vanquest DT and 2.0% owf of 56% acetic acid are loaded into the jet. The bath is run for five minutes at 120° F.

0.4% owb sodium nitrate and 4.0% owb sodium sulfate electrolyte are dissolved in about 40% of the calculated total water to bring the bath to a 10:1 liquids-to-goods volume and added to the jet dye apparatus. 0.2% owb Surfynol 104A is added and water is added to bring the bath to the 10:1 liquids-to-goods volume. The temperature is raised to 270° F. at a rate of 3° F./minute.

The prescoured Nomex® fabric is then dyed for an extended period of 60 minutes at an elevated temperature of about 270° F. and at a pressure of about 2.85 atm. The dyed fabric is cooled to 140° F., the shade checked. Based on this patch, an additional 0.675% owf Basacryl Yellow X-GFL and 10.1% owf sodium sulfate are added and the dye cycle run at 270° F. for 50 minutes. The dyebath is cooled to 140° F., shade checked and when acceptable, the dyebath is dropped.

An after-scour is done at a 10:1 liquor-to-goods ratio in a bath comprising about 2% owf of soda ash and about 2% owf Apex 1600 scouring agent. The temperature is raised to 160° F. and the fibers of the fabric scoured for 30 minutes at 160° F. The scouring bath is dropped and the fabric rinsed until the rinse is clear. The fabric is then dried. The fabric had a deep shade of blue and a C.I.E. L* value of 18.93.

The dyed fabric of Example 9 is tested for tear strength using Federal Test Method 191–5136 for Trapezoid Tear Strength. Test Method 191–5136 is a measurement of the tearing strength of woven fabrics. A test specimen of cloth, 3 inches by 6 inches is prepared. An isosceles trapezoid having an altitude of 3 inches and bases of 1 inch and 4 inches in length is marked on the specimen. A cut approximately ⅜ inch in length is made in the center of and perpendicular to the 1 inch edge. The specimen is placed in a machine described in Federal Test Method 5100 along the non-parallel sides of the trapezoid so that these sides lie along the lower edge of the upper clamp and the upper length of the lower clamp with the cut halfway between the clamps. The short trapezoid base is held taut and the long trapezoid base lies in the folds. The machine is started and the force necessary to tear the cloth is observed by means of an autographic recording device. The speed of the pulling clamp is 12 inches±0.5 inch per minute. The tearing strength of the specimen is the average of the five highest peak loads of resistance registered for 3 inches of separation of the tear. Five specimens in each of the warp and filling directions are tested from each sample unit. The tearing strength of the sample unit is the average of the results obtained from the specimens tested in each of the warp and filing directions and is reported separately to the nearest 0.1 pound. The results are reported in Table 1.

TABLE 1

| Trapezoid Tear Strength (lbs) | | | | | | | | | |
|---|---|---|---|---|---|---|---|---|---|
| Warp | | | | | Fining | | | | |
| 69 | 67 | 53 | 68 | 59 | 48 | 50 | 43 | 39 | 44 |
| 68 | 67 | 55 | 68 | 60 | 46 | 49 | 45 | 39 | 45 |
| 69 | 66 | 54 | 68 | 59 | 47 | 50 | 43 | 39 | 43 |
| 69 | 66 | 55 | 69 | 51 | 48 | 49 | 44 | 38 | 44 |
| 71 | 66 | 53 | 68 | 60 | 48 | 49 | 43 | 39 | 43 |
| 69 | 66 | 54 | 68 | 60 | 47 | 49 | 44 | 39 | 44 |
| Ave. 63.4 | | | | | Ave. 44.6 | | | | |

The tear strength is acceptable.

The dyed fabric of Example 9 is tested for vertical flame resistance using Federal Test Method 191-5903. Test Method 191-5903 is a measurement of the resistance of fabric to flame and glow propagation and tendency to char. A test specimen comprising a 2¾ inch by 12 inches (70 mm by 305 mm) is exposed to a Tirrill burner flame 3 inches (76 mm) in height by vertical suspension in the flame for 12 seconds, the lowest portion of the specimen ¾ inches (19 mm) above the center of the burner. The burner gas mixture is 55±3 percent hydrogen, 24±1 percent methane, 3±1 percent ethane and 18±1 percent carbon monoxide. At the end of 12 seconds, the specimen is withdrawn from the flame slowly, and the after-flaming (A-F) and after-glow (A-G) are timed.

After both flaming and glowing have ceased, the char length is measured. The char length is the distance from the end of the specimen, which was exposed to the flame, to the end of a tear (made lengthwise) of the specimen through the center of the charred area as follows: The specimen is folded lengthwise and creased by hand along a line through the highest peak of the charred area. The hook is inserted in the specimen (or a hole, ¼ inch (6 mm) diameter or less, punched out for the hook) at one side of the charred area ¼ inch (6 mm) from the adjacent outside edge and ¼ inch (6 mm) in from the lower end. A weight of sufficient size is attached to the hook. A tearing force is applied gently to the specimen by grasping the corner of the cloth at the opposite edge of the char from the load and raising the specimen and weight clear of the supporting surface. The end of the tear is marked off on the edge and the char length measurement made along the undamaged edge. The specific load applicable to the weight of the test cloth is as follows:

| Specified weight per square yard of cloth before any fire retardent treatment or coating | | Total tearing weight for determining the charred length | |
|---|---|---|---|
| Ounces per yard | $g/m^2$ | Pounds | kg |
| 2.0 to 6.0 | 68 to 203 | 0.25 | 0.1 |
| Over 6.0 to 15.0 | Over 203 to 508 | 0.5 | 0.2 |
| Over 15.0 to 23.0 | Over 508 to 780 | 0.75 | 0.3 |
| Over 23.0 | Over 780 | 1.0 | 0.45 |

The results for the original sample and after five (A/5) launderings are reported in Table 2.

TABLE 2

| Vertical Flame Resistance | | | | | |
|---|---|---|---|---|---|
| Warp | | | Filling | | |
| A/F (sec) | A/G (sec) | C.L. (inches) | A/F (sec) | A/G (sec) | C.L. (inches) |
| Original | | | | | |
| 0 | 2 | 2.5 | 0 | 3 | 2.4 |
| 0 | 2 | 2.5 | 0 | 3 | 2.3 |
| 0 | 2 | 2.5 | 0 | 5 | Z.3 |
| 0 | 4 | 2.6 | 0 | 4 | 2.4 |
| 0 | 2 | 1.2 | 0 | 4 | 1.8 |
| Ave. 0 | 2.4 | 2.3 | Ave. 0 | 3.8 | 2.2 |
| A/5 Washes | | | | | |
| 0 | 4 | 2.2 | 0 | 3 | 2.2 |
| 0 | 3 | 2.2 | 0 | 2 | 2.3 |
| 0 | 3 | 2.3 | 0 | 4 | 1.7 |
| 0 | 3 | 2.2 | 0 | 2 | 2.0 |
| 0 | 2 | 2.6 | 0 | 2 | 2.0 |
| 0 | 3.0 | 2.3 | 0 | 2.6 | 2.0 |

The dyed fabric of Example 9 is tested for flame resistance using Federal Test Method 191-5905 Flame Contact Test. Test Method 191-5905 is a measurement of the resistance of fabric and other textiles to flame propagation due to a flame source. An initial test specimen 2¾ inches by 12 inches (70 mm by 305 mm) is exposed to high temperature Meeker butane burner 3 inches (76 mm) in height by vertical suspension in the flame for 2 seconds, the lowest portion of the specimen always 1½ inches (38 mm) above the center of the burner. At the end of 12 seconds, the specimen is withdrawn from the flame slowly, and the after-flaming is timed. Then the specimen is re-introduced into the flame and again slowly withdrawn after 12 seconds and after-flame timed. Additionally, a second specimen is tested after five launderings at 140° F. under the conditions specified in AATCC Method 135-3II, B. The results are reported as percent consumed of the original specimen ("Original") and after five launderings ("A/5") wherein $$\text{Percent consumed} = \frac{L - A}{L \times 100}$$

where L=Original length of specimen where A=Length of uncharred part of specimen from the top of the specimen down the side with less charred area to the point at which the uncharred area first reaches a width of less than 1 inch (25 mm).

The results are reported in Table 3.

TABLE 3

| High Heat Flux Flame Contact Test | | | | | | |
|---|---|---|---|---|---|---|
| | WARP | | | | | |
| | A/F (sec.) | | A/G (sec.) | | Uncharred | % |
| Original | 1ST | 2ND | 1ST | 2ND | Inches | Consumed |

TABLE 3-continued

| High Heat Flux Flame Contact Test | | | | | | |
|---|---|---|---|---|---|---|
| | 0 | 0 | 1 | 4 | 10½ | 12.5 |
| | 1 | 0 | 0 | 0 | 10½ | 12.5 |
| | 0 | 2 | 2 | 0 | 11 | 8.3 |
| | 1 | 1 | 1 | 1 | 10¼ | 14.6 |
| | 8 | 0 | 0 | 0 | 10½ | 12.5 |
| Ave. | 2 | .6 | .8 | 1 | | 12.1 |
| | A/F (sec.) | | A/G (sec.) | | Uncharred | % |
| A/5 Washes | 1ST | 2ND | 1ST | 2ND | Inches | Consumed |
| | 0 | 2 | 0 | 0 | 10⅞ | 9.4 |
| | 0 | 0 | 1 | 2 | 10½ | 12.5 |
| | 0 | 0 | 1 | 0 | 10⅜ | 13.5 |
| | 1 | 1 | 2 | 2 | 10½ | 12.5 |
| | 2 | 0 | 0 | 0 | 10¼ | 14.6 |
| Ave. | .6 | .6 | .8 | .5 | | 12.5 |
| FILLING | | | | | | |
| | A/F (sec.) | | A/G (sec.) | | Uncharred | % |
| Original | 1ST | 2ND | 1ST | 2ND | Inches | Consumed |
| | 2 | 0 | 2 | 2 | 10½ | 12.5 |
| | 1 | 0 | 0 | 0 | 10½ | 12.5 |
| | 2 | 1 | 0 | 0 | 10¾ | 10.4 |
| | 0 | 0 | 3 | 4 | 10¼ | 14.6 |
| | 1 | 0 | 2 | 2 | 10 | 16.6 |
| Ave. | 1.2 | .2 | 1.4 | 1.6 | | 13.3 |
| | A/F (sec.) | | A/G (sec.) | | Uncharred | % |
| A/5 Washes | 1ST | 2ND | 1ST | 2ND | Inches | Consumed |
| | 0 | 0 | 0 | 4 | 10¼ | 14.6 |
| | 1 | 0 | 0 | 0 | 10½ | 12.5 |
| | 1 | 0 | 7 | 4 | 10⅛ | 15.6 |
| | 0 | 0 | 2 | 3 | 10⅛ | 15.6 |
| | 2 | 0 | 1 | 2 | 10¾ | 10.4 |
| Ave. | .8 | 0 | .8 | 2.6 | | 13.7 |

The results of both flame resistance tests indicate the acceptable flame resistance properties.

EXAMPLES 10–13

In order to demonstrate the effectiveness of various sodium sulfate electrolyte concentration, Example 1 is repeated except different amounts of sodium sulfate (anhydrous) are added with the 2.33% owb sodium xylenesulfonate dye assistant and 0.2% owb Surfyynol 104A as shown in Table 4.

TABLE 4

| | EXAMPLES | | | |
|---|---|---|---|---|
| | 10 | 11 | 12 | 13 |
| Amt. Sodium Sulfate Added (% owb) | 2.0 | 3.0 | 3.5 | 4.0 |
| C.I.E. L* Value | 18.64 | 17.97 | 18.07 | 18.71 |

EXAMPLES 14–18

In order to demonstrate the effectiveness of dyeing at varying pH, a 7.5 oz/yd$^2$ fabric formed from Nomex® T-455 (94% Nomex® and 6% Kevlar®) fibers is prescoured at 160° F. in a bath comprising 2% owf soda ash, 2% owf Apex 1600 scouring agent and 12.25% owf Naxonate 4L sodium xylenesulfonate (40.82% active). The prescour is conducted for 30 minutes.

A 10.0 g. sample of prescoured Nomex® is shaken at 120° F. for 5 minutes in an Ahiba cup with a dye assistant comprising 2.5% owb dissolved sodium xylenesulfonate, 0.133% owb Geropon SS-0-75, 0.03% owb Quadefome NS and 30–35% of the water needed to provide the full bath 10:1 liquid-to-goods volume. A stock navy blue cationic dye solution is added to the bath to provide 11.25% owf 100% Basacryl Blue X-3GL, 1.41% owf Basacryl Red GL and 0.90% owf Basacryl Golden Yellow X-GFL along with 0.013% owb Vanquest DT. This mix is shaken for five minutes at 120° F. The balance of water needed to provide the full bath volume is added along with 0.4% owb dissolved sodium nitrate. The dyebath pH is adjusted using sodium acetate as shown in Table 5. The temperature is raised to 270° F. at a rate of 3° F./minute. The 10 g sample of the prescoured Nomex® fabric is then dyed for an extended period of 60 minutes at an elevated temperature of about 270° F. and at a pressure of about 2.85 atm. The dyebath is cooled to 140° F. and then dropped and the fabric is rinsed clean in cold water.

An after-scour is done at a 10:1 liquor-to-goods ratio in a bath comprising about 2% owf of soda ash, and about 2% owf of Apex 1600 scouring agent. The temperature is raised to 160° F. and the fibers of the fabric scoured for 30 minutes at 160° F. The scouring bath is dropped and the fabric rinsed until the rinse is clear. The fabric is then dried.

TABLE 5

| | EXAMPLES | | | | |
|---|---|---|---|---|---|
| | 14 | 15 | 16 | 17 | 18 |
| Dyebath pH | 2.41 | 2.75 | 3.00 | 3.25 | 3.50 |
| C.I.E. L* Value | 17.77 | 18.22 | 18.09 | 17.51 | 19.54 |

The results of Examples 14–18 demonstrate that varying dyebaths pHs of from about 2 to 4 can be used.

EXAMPLES 19–26

In order to demonstrate the effectiveness of different dye temperatures, Example 5 is repeated at the dye cycle temperatures shown in Table 6.

TABLE 6

| | EXAMPLES | | | | | | | |
|---|---|---|---|---|---|---|---|---|
| | 19 | 20 | 21 | 22 | 23 | 24 | 25 | 26 |
| Dye Cycle Temperature of/60 min. | 200 | 210 | 220 | 230 | 240 | 250 | 260 | 270 |
| C.I.E. L* Value | 41.62 | 41.03 | 40.38 | 31.28 | 24.23 | 22.36 | 20.71 | 19.50 |

The results of Examples 19–26 indicate that the dye cycle temperature is preferably from about 240° F. to 270° F.

EXAMPLES 27–34

In order to demonstrate the effectiveness of different dye cycle times a series of examples was run at 10:1 liguid-to-goods ratio for different amounts of time as shown in Table 7. Each dyebath is made up as described in Example 5 except 2.79% owb sodium xylenesulfonate is used and 4.0% owb sodium sulfate is added in solution with the 0.4% owb sodium nitrate. The pH of each dyebath was adjusted to 3.73 with sodium acetate. The dye cycle is run at 270° F. for 60 minutes. An after-scour is done at a 10:1 liquor-to-goods ratio in a bath comprising about 2% owf of soda ash and about 2% owf Apex 1600 scouring agent. The temperature is raised to 160° F. and the fibers of the fabric scoured for 30 minutes at 160° F. The scouring bath is dropped and the fabric rinsed until the rinse is clear. The fabric is then dried.

TABLE 7

| | EXAMPLES | | | | | | | |
|---|---|---|---|---|---|---|---|---|
| | 27 | 28 | 29 | 30 | 31 | 32 | 33 | 34 |
| Dye Cycle Time (min.) | 15 | 30 | 45 | 60 | 75 | 90 | 105 | 120 |
| C.I.E. L* Value | 20.17 | 17.37 | 19.25 | 19.14 | 18.84 | 19.10 | 18.99 | 19.46 |

The results of Examples 27–34 indicate the dye cycle time is preferably from about 30 to 105 minutes.

EXAMPLES 35–38

In order to demonstrate the effectiveness of different salts of aromatic sulfonic acids, a series of dyeings are run with each dyebath containing 2.5% owb of the indicated salt of a sulfonic acid listed in Table 8, 4.0% owb sodium sulfate, 0.4% owb sodium nitrate, 0.2% owb Surfynol 104A and 20 ml of a stock navy blue cationic dye solution containing 11.25% owf 100% Basacryl Blue X-3GL, 1.41% owf Basacryl Red GL and 0.90% owf Basacryl Golden Yellow X-GFL along with 0.013% owb Vanquest DT. The pH of each dyebath was adjusted to 3.5–3.75 range with sodium acetate. The dye cycle is run at 270° F. for 60 minutes. An after-scour is done at a 10:1 liquor-to-goods ratio in a bath comprising about 2% owf of soda ash and about 2% owf Apex 1600 scouring agent. The temperature is raised to 160° F. and the fibers of the fabric scoured for 30 minutes at 160° F. The scouring bath is dropped and the fabric rinsed until the rinse is clear. The fabric is then dried.

TABLE 8

| Salt | Example No. | C.I.E.L* |
|---|---|---|
| p-toluenesulfonic acid | 35 | 17.70 |
| cumenesulfonic acid | 36 | 17.76 |
| 2-naphthalenesulfonic acid | 37 | 17.69 |
| 1-napthalenesulfonic acid | 38 | 17.91 |

In the specification and examples, there have been disclosed preferred embodiments of the invention, although specific terms are employed, they are used in a generic and descriptive sense only and not for the purpose of limitation, the scope of the invention being defined by the following claims.

That which is claimed is:

1. A method for dyeing fibrous material which is particularly adapted for use in reducing the adverse effect of dyeing methods on the flame resistant properties of fibrous material having inherent flame resistant properties, the method comprising contacting a fibrous material selected from the group consisting of aromatic polyamide fibers, polybenzimidazole fibers, aromatic polyimide fibers, fibers of copolymers of the monomers thereof, or blends thereof, with an aqueous dyebath comprising a mixture of a dye assistant and a dye soluble or dispersed with the dye assistant in the dyebath, the dye assistant comprising a salt of an aromatic sulfonic acid having 6 to 12 carbon atoms, wherein the step of contacting the fibrous material with the aqueous dyebath is conducted at a temperature of from about 100° F. to 300° F. and at a pressure of from about 1 to 4 atm.

2. The method according to claim 1, wherein the salt of an aromatic sulfonic acid is an ammonium, sodium or potassium salt of an acid selected from the group consisting of p-toluenesulfonic acid, m-nitrobenzenesulfonic acid, xylenesulfonic acid, cumenesulfonic acid, α-napthalenesulfonic acid, and β-napthalenesulfonic acid.

3. The method according to claim 1, wherein the aqueous dyebath further includes 2,4,7,9-tetramethyl-5-decyne-4,7 diol.

4. The method according to claim 1, wherein the salt of an aromatic sulfonic acid is an ammonium or alkali metal salt of xylenesulfonic acid.

5. The method according to claim 1, wherein the step of contacting the fibrous material with the aqueous dyebath is conducted at a pH of about 2 to 4.

6. The method according to claim 1, wherein the aqueous dyebath further includes sodium dioctylsulfosuccinate.

7. The method according to claim 3, wherein the aqueous dyebath further includes an electrolyte.

8. The method according to claim 7, wherein the electrolyte is sodium nitrate or sodium sulfate or both.

9. The method according to claim 1, wherein the aromatic polyamide is poly(m-phenyleneisophthalamide), poly(p-phenyleneterephthalamide), copolymers of the monomers thereof, or blends thereof.

10. The method according to claim 1, wherein the step of contacting the fibrous material with the aqueous dyebath is conducted at a temperature of above about 250° F. and at a pressure of above about 2.5 atm, and held at the temperature and pressure for about 30 minutes to about 1.5 hours.

11. The method according to claim 1, wherein the dye is selected from the group consisting of basic, disperse, acid, and vat dyes.

12. A method for dyeing fibrous material comprising the steps of:

(a) prescouring a fibrous material selected from the group consisting of aromatic polyamide fibers, polybenzimidazole fibers, aromatic polyimide fibers, fibers of copolymers of the monomers thereof, or blends thereof, with an aqueous bath comprising a salt of an aromatic sulfonic acid having 6 to 12 carbon atoms and (b) contacting a fibrous material with an aqueous dyebath comprising a mixture of a dye assistant and a dye soluble or dispersed with the dye assistant in the dyebath, the dye assistant comprising a salt of an aromatic sulfonic acid having 6 to 12 carbon atoms.

13. The method according to claim 12, wherein the salt of an aromatic sulfonic acid is an ammonium, sodium or potassium salt of an acid selected from the group consisting of p-toluenesulfonic acid, m-nitrobenzenesulfonic acid, xylenesulfonic acid, cumenesulfonic acid, α-napthalenesulfonic acid, and β-napthalenesulfonic acid.

14. The method according to claim 12, wherein the aqueous dyebath further includes 2,4,7,9-tetramethyl-5-decyne-4,7 diol.

15. The method according to claim 12, wherein the salt of an aromatic sulfonic acid is an ammonium or alkali metal salt of xylenesulfonic acid.

16. The method according to claim 12, wherein the step of contacting the fibrous material with the aqueous dyebath is conducted at a pH of about 2 to 4.

17. The method according to claim 12, wherein the aqueous dyebath further includes sodium dioctylsulfosuccinate.

18. The method according to claim 14, wherein the aqueous dyebath further includes an electrolyte.

19. The method according to claim 18, wherein the electrolyte is sodium nitrate or sodium sulfate or both.

20. The method according to claim 12, wherein the aromatic polyamide is poly(m-phenyleneisophthalamide), poly(p-phenyleneterephthalamide), copolymers of the monomers thereof, or blends thereof.

21. The method according to claim 12, wherein step (b) of contacting the fibrous material with the aqueous dyebath is conducted at a temperature of from about 100° F. to 300° F. and at a pressure of from about 1 to 4 atm.

22. The method according to claim 12, wherein step (b) of contacting the fibrous material with the aqueous dyebath is conducted at a temperature of above about 250° F. and at a pressure of above about 2.5 atm, and held at the temperature and pressure for about 30 minutes to about 1.5 hours.

23. The method according to claim 12, wherein the dye is selected from the group consisting of basic, disperse, acid, and vat dyes.

24. The method according to claim 12, wherein the aqueous dyebath further includes a minor proportion of an agent for providing the dye in solution and for carrying the dye into the fibrous material, wherein said agent is selected from the group consisting of N-substituted aromatic carbonamides and N,N-disubstituted aromatic dicarbonamides.

25. A method for dyeing fibrous material which is particularly adapted for use in reducing the adverse effect of dyeing methods on the flame resistant properties of fibrous material having inherent flame resistant properties, the method comprising contacting a fibrous material selected from the group consisting of aromatic polyamide fibers, polybenzimidazole fibers, aromatic polyimide fibers, fibers of copolymers of the monomers thereof, or blends thereof, with an aqueous dyebath comprising a mixture of a dye assistant comprising a salt of an aromatic sulfonic acid having 6 to 12 carbon atoms; an agent for providing the dye in solution and for carrying the dye into the fibrous material, wherein said agent is selected from the group consisting of N-substituted aromatic carbonamides and N,N-disubstituted aromatic carbonamides; and a dye soluble or dispersed with the dye assistant in the dyebath.

26. A method according to claim 25, wherein the salt of an aromatic sulfonic acid is an ammonium, sodium or potassium salt of an acid selected from the group consisting of p-toluenesulfonic acid, m-nitrobenzenesulfonic acid, xylenesulfonic acid, cumenesulfonic acid, α-napthalenesulfonic acid, and β-napthalenesulfonic acid.

27. A method according to claim 25, wherein the aqueous dyebath further includes 2,4,5,9-tetramethyl-5-decyne-4,7 diol.

28. A method according to claim 25, wherein the salt of an aromatic sulfonic acid is an ammonia or alkali metal salt of xylenesulfonic acid.

29. A method according to claim 25, wherein the step of contacting the fibrous material with the aqueous dyebath is conducted at a pH of about 2 to 4.

30. A method according to claim 25, wherein the aqueous dyebath further includes sodium dioctylsulfosuccinate.

31. A method according to claim 27, wherein the aqueous dyebath further includes an electrolyte.

32. A method according to claim 31, wherein the electrolyte is sodium nitrate or sodium sulfate or both.

33. A method according to claim 25, wherein the aromatic polyamide is poly(m-phenyleneisophthalamide), poly(p-phenyleneyterephthalamide), copolymers of the monomers thereof, or blends thereof.

34. A method according to claim 25, wherein the step of contacting the fibrous material with the aqueous dyebath is conducted at a temperature of from about 100° F. to 300° F. atm at a pressure of from about 1 to 4 atm.

35. A method according to claim 35, wherein the step of contacting the fibrous material with the aqueous dyebath is conducted at a temperature of above about 250° F. and at a pressure of above about 2.5 atm, and held at the temperature and pressure for about 30 minutes to about 1.5 hours.

36. A method according to claim 25, wherein the dye is selected from the group consisting of basic, disperse, acid, and vat dyes.

* * * * *

UNITED STATES PATENT AND TRADEMARK OFFICE

CERTIFICATE OF CORRECTION

PATENT NO. : 5,427,589

DATED : June 27, 1995

INVENTOR(S) : John R. Holsten and Moses Smith, Jr.

It is certified that error appears in the above-identified patent and that said Letters Patent is hereby corrected as shown below:

ON THE COVER PAGE, References, U.S. Patents, "Russell" should be -- Russell et al; and insert -- 4,752,300 6/1988 Johnson --.

Column 9, Table 1, line 20, "Fining" should be -- Filling --; columns 5 and 6 of Table 1.

Column 10, Table 2, line 23, last column (line 3), "Z.3" should be -- 2.3 --; line 41, "2" should be -- 12 --.

Column 16, line 35, "35" should be -- 25 --.

Signed and Sealed this

Seventh Day of November, 1995

Bruce Lehman

*Attest:*

BRUCE LEHMAN

*Attesting Officer*

*Commissioner of Patents and Trademarks*